US005769995A

United States Patent [19]

Greyerbiehl

[11] Patent Number: 5,769,995

[45] Date of Patent: Jun. 23, 1998

[54] DEVICE AND METHOD FOR REINFORCING A PIERCED EARLOBE

[76] Inventor: MaryAnne Greyerbiehl, 11746 Gratiot Rd., Saginaw, Mich. 48609

[21] Appl. No.: 488,944

[22] Filed: Jun. 9, 1995

[51] Int. Cl.[6] ..... B32B 31/00

[52] U.S. Cl. ..... 156/250; 24/304; 63/12; 63/13; 63/14.1; 63/14.3; 156/94; 156/97; 156/252; 156/253; 156/261

[58] Field of Search ..... 156/94, 97, 250, 156/252, 253, 261; 63/12, 14.3, 13, 14.1, DIG. 1; 24/304; 428/40.1, 131

[56] References Cited

U.S. PATENT DOCUMENTS

| | | | |
|---|---|---|---|
| 4,089,189 | 5/1978 | Verducci | 63/12 |
| 4,383,002 | 5/1983 | Manolescu | 63/12 |
| 4,974,430 | 12/1990 | Turner | 63/12 |
| 5,444,994 | 8/1995 | Poortinga et al. | 63/14.3 |
| 5,537,841 | 7/1996 | Bradvica | 63/12 |
| 5,638,701 | 6/1997 | Dempsey | 63/12 |

*Primary Examiner*—Nasser Ahmad
*Attorney, Agent, or Firm*—Learman & McCulloch

[57] ABSTRACT

An adhesive-backed patch of reinforcement material has a central aperture and is applied to the pierced earlobe of a person's ear in position with the aperture aligned with the orifice of the earlobe to support the weight of the pierced earring installed in the orifice and distribute that weight to the tissue of the earlobe surrounding the orifice to which the patch is adhered. The patch may be used as a preventative measure to prevent damage to a person's earlobe as a result of wearing pierced earrings or may be used to reconstruct a torn or damaged orifice to regain usage of the earlobe.

22 Claims, 2 Drawing Sheets

DEVICE AND METHOD FOR REINFORCING A PIERCED EARLOBE

This invention relates to devices and methods for reinforcing the orifice of a person's pierced ear to relieve the stress normally placed on the ear by an earring and to provide an allergy-free barrier between the person's ear and the pendant of an earring for the benefit of those who are prone to be allergic to contact with metal.

BACKGROUND OF THE INVENTION

It is common for persons who wish to wear earrings to have their earlobes pierced in order to provide an orifice for the accommodation of a pierced earring. This manner of supporting an earring within the ear sometimes, however, causes problems. For example, if a person wears heavy earrings for an extended period of time, the weight of the earring is borne entirely by the wall of the orifice causing it to stretch and, in some cases, with permanent deformation. Another problem that is frequently encountered by those who have pierced ears is that the earring becomes snagged or is pulled with sufficient force to tear the post of the earring through the tissue of the earlobe free of the orifice. If allowed to heal in this condition, the orifice may remain open and, as such, would be unable to continue supporting an earring. In other instances, the tear may partially heal but remain sufficiently weak as to be more readily susceptible to repeated tearing or discomfort if the person were to continue wearing an earring. Usually, a person who experiences a torn orifice will discontinue use of the orifice all together and have the lobe pierced in a new location.

Thus, there is a need for a device that can reinforce the orifice of a person's earlobe to prevent the orifice from being permanently stretched or torn and further that will enable a person with such a deformed or torn earlobe to reconstruct the orifice to permit the person to regain usage of the otherwise useless orifice.

SUMMARY OF THE INVENTION AND ADVANTAGES

A method is provided for reinforcing an orifice of a pierced earlobe to provide support to an earring accommodated within the orifice. In a preferred embodiment, a patch of reinforcement material having an adhesive applied to at least one side thereof is formed with an aperture that approximates the size of a post of an earring. To apply the reinforcement patch to the ear, the post of the earring is extended through the aperture of the patch and then extended through the orifice of the earlobe. The adhesive adheres the patch to the skin of the earlobe surrounding the orifice with the aperture of the patch aligned with the orifice of the earlobe. The weight of the earring is transferred to the patch through the post of the earring, and that weight in turn is distributed across the contact area of the patch to the tissue of the earlobe surrounding the orifice. In this way, the weight of the earring is not concentrated entirely on the wall of the orifice but, instead, is spread out over the much larger area of the patch to relieve stress on the earlobe.

It is contemplated that the reinforcement would be used by some individuals as a preventative measure to guard against potential damage to the earlobe as well as by others as a reconstruction device for torn, stretched, or otherwise weakened pierced earlobes. When used as a reconstruction device, the patch is extended onto the post in the same manner and the post is thereafter extended through the damaged orifice and positioned preferably in the top region of the orifice corresponding to where the orifice originally was before being damaged. The patch is then adhered to the surface of the earlobe with the aperture serving as an artificial orifice coupled to the surrounding healthy tissue via the reinforcement material and adhesive of the patch, enabling the person to regain usage of the torn or damaged orifice.

The adhesive patch provides a simple, reliable, safe, and inexpensive means of maintaining. a healthy pierced earlobe or reconstructing a damaged one.

BRIEF DESCRIPTION OF THE DRAWINGS

Presently preferred embodiments of the invention are disclosed in the following description and in the accompanying drawings, wherein.

DETAILED DESCRIPTION

Figure 3:
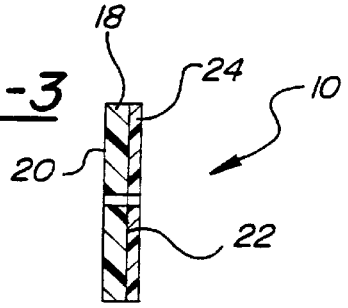
FIG. 3 is a cross-sectional view taken along lines 3—3 of FIG. 2.

A patch 10 for reinforcing or reconstructing an orifice or passage 12 of a person's pierced earlobe 14 (FIGS. 1 and 10) extending between opposing front 46 and back 42 surfaces of the earlobe 14 to provide support to a pierced earring 16 when installed in the earlobe 14 comprises a small and preferably circular swatch of reinforcing material 18 having flat, parallel front and back side surfaces 20, 22 and an adhesive backing 24 applied to the back side surface 22, as illustrated in FIG. 3, that is self-adhering to the skin of a person.

Figure 1:
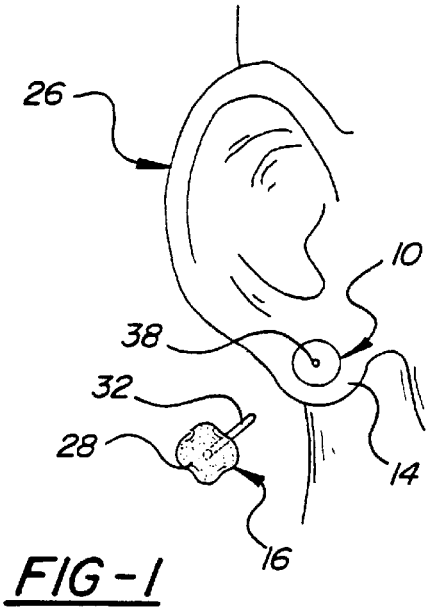
FIG. 1 is a perspective view of an earlobe reinforcement patch constructed according to a first embodiment of the invention shown attached to a person's pierced earlobe.
Figure 10:
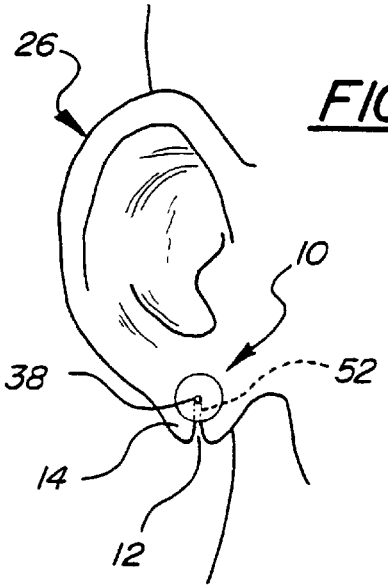
FIG. 10 is a view like FIG. 1 but showing the reinforcement patch applied to a torn earlobe.

As best seen in FIGS. 1 and 10, the patch 10 is relatively small in comparison to a person's ear 26 and is of such size to enable the patch to be applied to the earlobe region 14 of the ear 26. For various reasons, including the fact that earlobes vary in size among individuals, the patches 10 could be available in a variety of sizes having an outer dimension of about 3/16 inch to 3/8 inch in diameter, although somewhat larger or smaller patches could be utilized.

Figure 5:
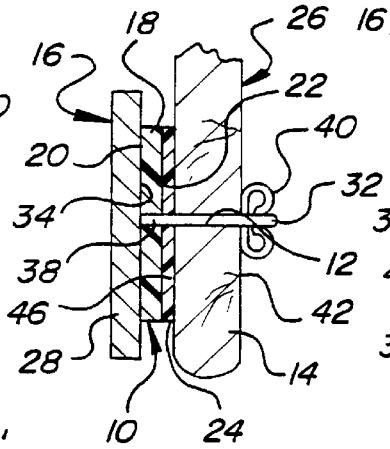
FIG. 5 is a cross-sectional view like FIG. 4 but shown attached to a person's pierced earlobe.

The particular size appropriate for each individual may depend on a number of other factors, as well, including the size, style, and weight of the earring to be supported. For earrings of the type having a decorative ornament or pendant portion 28 that is supported within the earlobe by a straight post 32 projecting from a backside 34 of the pendant 28, as illustrated in the drawings, the appropriate size patch may depend to some degree on the size of the pendant 28, particularly if the person wishes to have the patch 10 concealed or hidden behind the pendant 28. In such case, a patch having an outer dimension relatively smaller than that of the pendant 28 would be appropriate, as illustrated in FIG. 5. For those who have skin allergies to metal, the patch 10 can further serve as a protective barrier between the skin of the earlobe 14 and the backside 34 of the pendant 28 (usually metal). In such case, one may wish to select a patch 10 somewhat larger than the pendant 28 to assure that there is no contact between the pendant 28 and skin of the earlobe 14. Knowing that many individuals suffer from various skin allergies, it is preferred that the patch 10 itself be fabricated from hypoallergenic materials. One such material that has shown to work well is a hypoallergenic plastic adhesive tape product manufactured by 3M and marketed under the trademark "TRANSPORE". Of course, other such hypoallergenic adhesive tape products available on the market would also be suitable patch material. In addition to being hypoallergenic, the preferred material is also relatively transparent when applied to the skin of a person and, when used as an earlobe patch 10, is fairly unnoticeable.

Figure 8:
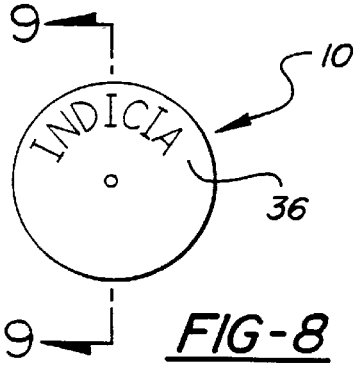
FIG. 8 is a front view of another embodiment of the invention in which the front surface of the reinforcement patch is provided with indicia.
Figure 9:
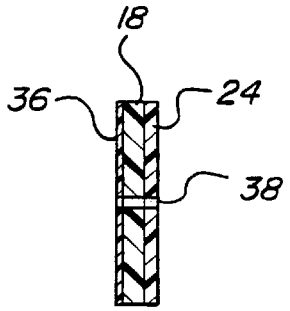
FIG. 9 is a cross-sectional view taken along lines 9—9 of FIG. 8.

For earrings with a dangling style pendant that is suspended below the earlobe by in the form of a hook-shaped wire or a hoop, the user may wish to apply a relatively smaller patch since, unlike the style of earring illustrated, the pendant does not overlie the earlobe and, hence, would not be capable of concealing the patch 10 when applied to the earlobe 14. On the other hand, others may wish to make use of the patch 10 as a fashion accessory or for promotional purposes, in which case a suitable color, design, logo, statement, decorative material, or other form of indicia 36 could be applied to the front side surface 20 of the patch 10 during manufacturing, as illustrated in FIGS. 8 and 9.

The weight of the earring to be supported is another consideration in selecting the appropriate size patch. For heavy earrings, it would be desirable to utilize a larger patch 10, since it would provide increased contact area with the skin of the earlobe surrounding the orifice 12 and, hence, serve to distribute the weight of the earring over a larger area of the earlobe thereby reducing the localized stress on the orifice 12, as will be explained in greater detail below.

Taking the various considerations into account, it is contemplated that perhaps three different sizes could be made available for selection by the user, such as small ¼ inch, medium 5/16 inch, and large ⅜ inch diameter. Of course, more or less size options could be offered.

Figure 2:
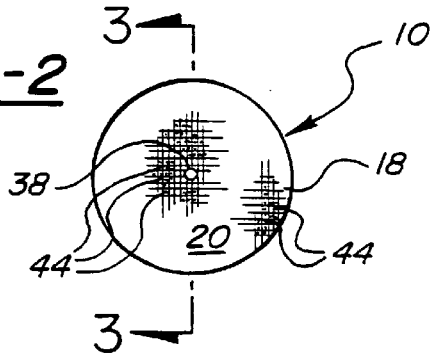
FIG. 2 is an enlarged front view of the reinforcement patch of FIG. 1.

It is preferred that the patch 10 have a circular shape, as illustrated in FIG. 2 in order to conform to the general shape of the earlobe and provide maximum uniform contact area. Other shapes and designs could also be utilized.

As illustrated in FIGS. 2 and 3, the patch 10 is formed with a central aperture or opening 38 that, when the patch 10 is applied to the earlobe 14, is aligned with the orifice 12 of the earlobe and through which the post 32 of the earring 16 is extended so as to engage the post 32 and transfer the weight of the earring 16 from the orifice 12 to the patch 10. Because of its adhesion to the earlobe 14, the patch 10 distributes the weight of the earring 16 across the contact area of the patch 10 and to the tissue of the earlobe surrounding the orifice 12.

The aperture 38 is preferably about the same size as that of the post 32. A standard pierced earring post 32 has a diameter of about 1/64 of an inch, although posts do vary somewhat in diameter, depending on the material that is used for the post and the manufacturer, but usually are no larger than 1/32 of an inch and are not known to be as large as 1/16 of an inch. It is preferred that the aperture 38 be formed to have initially a diameter that is relatively smaller than a standard post of a pierced earring, such that when the post 32 is extended through the aperture 38, the aperture 38 of the flexible patch material is caused to enlarge and fit snugly around the post 32 to provide. optimum support for the earring 16 when in the earlobe. The aperture 38 may be formed by piercing the patch 10 with a pin or similar tool to a diameter preferably of about 1/64 of an inch or less, although the aperture could be slightly larger, depending on the size of the earring post which is to be installed in the aperture, and as such, but in most cases should not exceed 1/16 inch in diameter.

Figure 4:
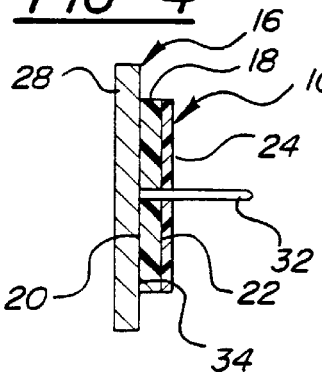
FIG. 4 is a cross-sectional view showing the reinforcement patch of FIGS. 2 and 3 threaded onto the post of a pierced earring in preparation for attachment to the earlobe.

To use the patch 10 to reinforce a pierced earlobe 14, the patch 10 is applied to the front surface 46 of the earlobe 14, as illustrated in FIG. 1, with the aperture 38 aligned with the orifice 12 of the earlobe and with the patch 10 being confined to the front surface 46 of the earlobe 14 adhesive backing layer 24 releasably adheres the patch 10 to the skin of the earlobe 14 surrounding the orifice 12. A preferred and convenient way of positioning and applying the patch 10 to the earlobe 14 is illustrated in FIGS. 4 and 5 and involves first mounting the patch 10 on the post 32 of the earring 16 by threading the post 32 through the aperture 38, such that the adhesive layer 24 of the patch 10 is facing outwardly toward the free end of the post 32, as illustrated in FIG. 4. The post 32 may then be extended through the orifice 12 of the earlobe and the patch 10 pressed against the skin of the earlobe 14, thereby adhering the patch 10 in the proper aligned position with respect to the orifice 12.

A friction clutch or nut 40 or other suitable locking device may then be installed on the free end of the post 32 projecting out of the orifice 12 from the back side 42 of the earlobe 14, in conventional manner to secure the earring against removal. The weight of the earring 16, and particularly that of the ornamental pendant portion 28, is transferred to the patch 10 by engagement of the lower portion of the aperture 38 with the post 32 of the earring. The patch 10, in turn, distributes the weight to the tissue of the earlobe 14 that surrounds the orifice 12. In this way, the orifice 12 is isolated from having to bear the entire weight of the earring 16, as would be the case if no patch at all were used, or if the patch were not secured to the earlobe by an adhesive.

It is preferred that the adhesive 24 of the patch 10 be one that adheres to the skin of the earlobe 14 when applied but yet enables the ready removal of the patch 10 when desired and without damaging or irritating the skin. It is contemplated that persons using the patches will replace them on a daily basis.

In addition to supporting the earring 16, the patch 10 further serves as a physical barrier between the pendant 28 and the skin of the earlobe 14 to prevent direct contact therebetween. This is particularly advantageous for those persons having metal allergies and, as mentioned previously, it is accordingly preferred that the patch 10 itself be fabricated of hypoallergenic materials.

The preferred 3M adhesive backed patch 10 material is formed with a plurality of minute geometrically arranged perforations, illustrated in FIG. 2 at 44, which are provided to render the material porous. A central one of the perforations 44 may be utilized as the aperture 38 and enlarged to the diameter of the earring post 32 by extending the post 32 through the central perforation 44, however, it is preferred that the perforation 44 be enlarged somewhat prior to insertion of the earring post 38 by extending a needle or other piercing tool through the perforation during manufacturing of the patch 10, so that it is relatively larger than the surrounding perforations 44 and yet initially smaller in diameter than the earring post 32, as illustrated in FIGS. 2 and 3. In this way, the aperture 38 is more visible to the user and requires relatively less effort to extend the post 32 through the aperture 38, as compared to extending the post 32 through one of the preformed perforations.

Figure 6:
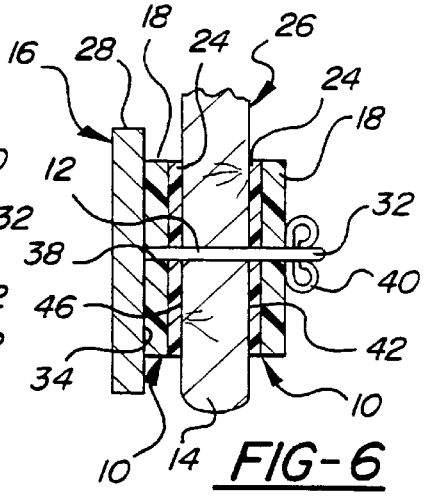
FIG. 6 is a view like FIG. 5 but of an alternative arrangement using two reinforcement patches provided on opposite sides of the earlobe.

FIG. 6 illustrates a variation of the method described above for reinforcing the orifice of a pierced earlobe in which a patch 10 is applied to both the front side 46 and back side 42 of the earlobe rather than just the front side. The additional patch 10 applied to the backside 42 provides additional support to the earring in the same manner as the opposing patch, and further provides a barrier between the skin of the earlobe 14 and the friction nut 40. The backside patch 10 is of the same construction as that of the frontside patch 10 and is aligned in similar manner with the orifice 12 of the earlobe 14 and the patch confined to the back surface 42 of the earlobe 14. The preferred manner of positioning and installing the backside patch 10 is by threading the backside patch 10 onto the free end of the post 32 after it has been extended through the orifice 12 of the earlobe 14 and prior to installation of the friction nut 40.

Figure 7:
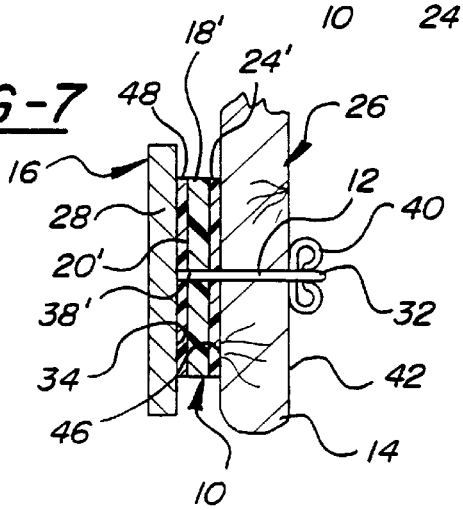
FIG. 7 is a cross-sectional view of an alternative construction of the reinforcement patch in which adhesive is applied to both surfaces of the patch.

FIG. 7 shows an alternative construction of a patch 10' similar to the patch 10 described above but having an additional adhesive layer 48 applied to the front side 20' of the reinforceable material 18'. It is preferred that the adhesive layer 48 also be hypoallergenic to render the patch 10' reversible so that the layer 48 could be adhered to the earlobe if the patch is inverted. As shown in FIG. 7, the additional adhesive layer 48 adheres to the backside 34 of the pendant 28 and operates to hold the earring 16 to the earlobe 14, particularly in the event that the friction nut 40 is inadvertently removed from the post 32, thereby preventing the loss of an earring that might otherwise occur.

FIG. 10 illustrates another application of the patch 10 in which it is used to reconstruct or reinforce a torn, enlarged, or otherwise damaged orifice 12 of an earlobe 14 to enable the user to regain use of the orifice 12 for the purpose of supporting a pierced earring.

The same construction of patch and procedure for installing the patch on the earlobe may be used as that described above with the added step of aligning the aperture 38 of the patch 10 with the top or uppermost region of the orifice 12, as illustrated in FIG. 10, corresponding to the original position of the orifice before being damaged or torn. FIG. 10 shows an extreme case in which the orifice 12 of the earlobe 14 has been completely torn through the ear such as to be incapable of supporting a pierced earring without usage of the patch 10. As shown, the patch 10 extends across or bridges the torn orifice to effectively reconstruct, by artificial means of the patch 10, the damaged orifice 12 so that the earlobe. 14 may again support a pierced earring. The patch 10 is equally effective in reconstructing pierced earlobes whose orifice 12 has become elongated or enlarged through extended wearing of heavy earrings and may be repaired in the same manner as described for the torn earlobe. It is also advantageous in the case of a torn or damaged earlobe to utilize a second patch in the manner illustrated in FIG. 6 to provide additional support to the earring and help distribute the weight of the earring more uniformly to the healthy tissue of the earlobe surrounding the torn or damaged orifice 12 via the adhesive 24.

Figure 11:
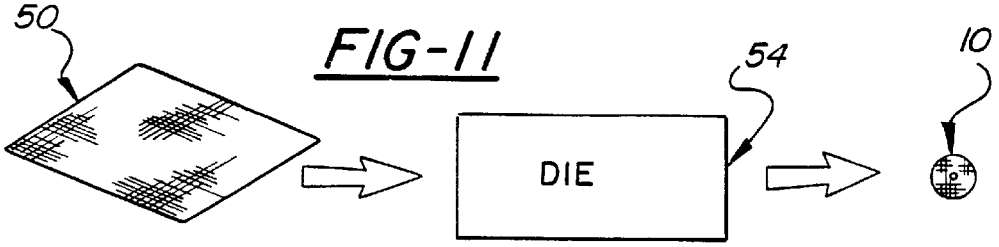
FIG. 11 illustrates schematically a process for manufacturing the reinforcement patches of FIGS. 1–10.

FIG. 11 illustrates a method of producing the patches 10 described above. As shown, a sheet of the patch material 50 is fed to a die 54 which stamps or cuts one or more sizes of patches 10 from the sheet 50 and, preferably in the same operation, forms the aperture 38. If desired, the indicia 36 may be applied during manufacture of the sheet 50 by conventional printing or laminating techniques before or after the stamping operations, or to the individual patches 10.

Figure 12:
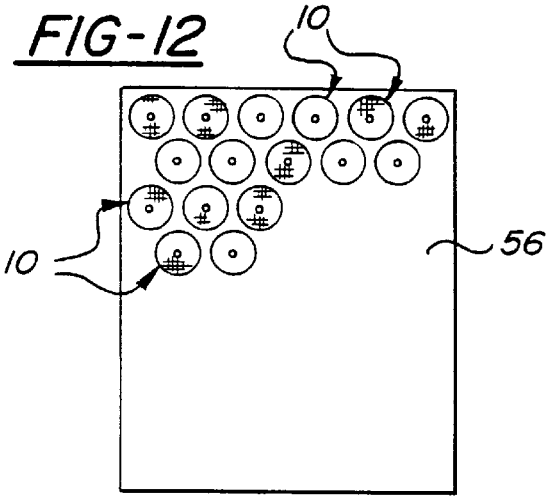
FIGS. 12–14 show alternative constructions for mounting and carrying a plurality of the reinforcement patches in preparation for use.
Figure 13:
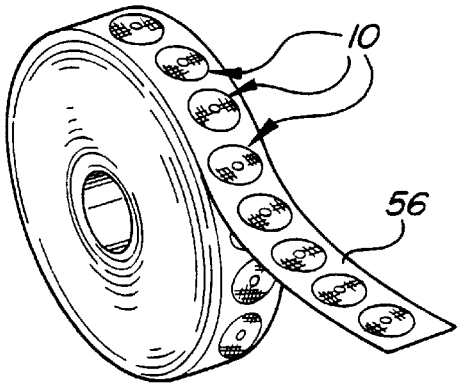
Figure 14:
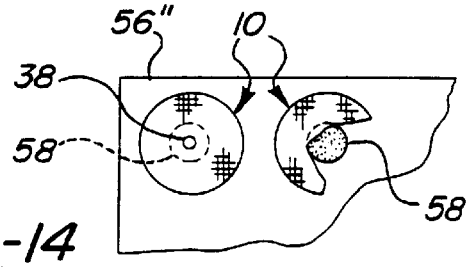

FIGS. 12 and 13 illustrate a manner of carrying or mounting a plurality of the patches 10 for display purposes and/or for subsequent use by the consumer. FIG. 12 illustrates a plurality of patches 10 applied to a non-stick carrier sheet 56 to which the adhesive 24 of the patch 10 removably adheres to. FIG. 13 illustrates a roll or tape of the non-stick carrier sheet material 56' on which the patches 10 may be applied for storage and resale. The sheet material 56 may comprise any of a number of non-stick plastic material compatible with the adhesive 23 so as to enable the patch 10 to be removed from the sheet 56 without damaging either the sheet 56 or patches 10. Other known materials such as waxed paper-type sheet materials known for their non-adherent properties could also be used for the carrier sheet 56, 56'.

According to another aspect of the invention, the patches 10 may be mounted on a carrier strip 56' of sheet or tape form described above that has indicia 58 provided thereon aligned with the aperture 38 of the patch 10 to provide a visual indication to the user of where the aperture is to enable the user to readily locate and extend the post 32 of the earring through the aperture 38 when installing the patch 10 on the post 32. The indicator 58 may comprise a darkened region, as shown, but may also be of other configurations such as an open circle, an "x", an arrow, etc. indicating the location of the aperture 38. The indicators 58 are particularly useful in connection with transparent patches 10 wherein the indication 58 can be seen through the patch material.

The disclosed embodiments are representative of a presently preferred forms of the invention, but is intended to be illustrative rather than definitive thereof. The invention is defined in the claims.

I claim:

1. A method of reinforcing an orifice of a pierced earlobe extending between opposing front and back surfaces of the earlobe to provide support to an earring having a post adapted for extension through the passage accommodated within the orifice, said method comprising the steps of:

providing a patch of reinforcement material having an adhesive applied to at least one side of the patch that is releasably adherable to the skin of a person and being of such size to enable the patch to be adhered to one of the earlobe surfaces of the person in position over the passage and with the patch being confined only to the earlobe surface to which it is applied;

extending the post of the earring through the passage of the earlobe and adhering the patch to one of the earlobe surfaces in position over the passage and being confined only to such surface of the earlobe with the mounting portion of the earring projecting through an opening in the patch aligned with the passage, whereby the weight of the earring is borne by the patch and distributed across the contact area of the patch with the earlobe.

2. The method of claim 1 wherein the opening of the patch is aligned by first extending the post of the earring through the opening of the patch and thereafter extending the post of the earring through the passage.

3. The method of claim 1 including forming the opening in the patch by extending the post through the patch to provide a close fit of the opening around the post.

4. The method of claim 3 including forming the patch from material having a plurality of spaced apart preformed perforations relatively smaller in diameter than the mounting portion of an earring.

5. The method of claim 1 including forming the patch with a peripheral outer dimension sufficiently large in relation to a pendant of the earring to provide a barrier between the skin of the person and the pendant.

6. The method of claim 3, including forming the patch with an outer diameter of between about 3/16 inch in diameter and 3/8 inch diameter.

7. The method of claim 6 including forming the opening to have a diameter of less than 1/16 inch.

8. The method of claim 1 including forming the patch from a hypoallergenic material.

9. The method of claim 1 including forming the patch from hypoallergenic material having adhesive applied to both sides thereof, and including the steps of adhering one side of the patch to the skin of the person and the other side of the patch to an adjacent surface of the earring.

10. The method of claim 1 including providing a pair of disconnected said patches and applying one patch to the front surface of the person's earlobe and applying the other patch to the back surface of the person's earlobe with both being positioned over the passage and each being confined only to their respective front and back surfaces of the earlobe and with the openings of each patch being aligned with the passage of the pierced earlobe, and extending the post of the earring through the openings of the patches and the passage of the earlobe.

11. The method of claim 1 including forming the patch from a transparent material and forming a non-stick carrier sheet having indicator markings thereon, and mounting a plurality of the transparent patches on the carrier sheet in position over the indicator markings to identify to the person the location for the openings of the patches, and thereafter extending the post of the earring through selected ones of the patches and lifting each patch free of the carrier sheet for subsequent application to the earlobe of the person.

12. A method of reconstructing a torn earring support passage of a person's pierced earlobe extending between opposite front and back surfaces of the earlobe to enable such person to support an earring in an upper portion of the passage corresponding to the original location of the passage before being torn above an enlarged lower damaged portion of the passage, said method comprising the steps of:

providing a patch of reinforcement material having an adhesive applied to at least one side of the patch that is releasably adherable to the skin of a person and being of such size to enable the patch to be adhered to one of the surfaces of the earlobe in position over the passage and with the patch being confined only to the earlobe surface to which it is applied;

positioning the post of the earring within the upper portion of the passage and supporting the maintaining the post within said upper portion by adhering the patch to one of the earlobe surfaces in position over the passage with the post of the earring projecting through an opening in the patch aligned with the upper portion of the passage and the post and with the patch being confined only to the surface of the earlobe to which it is applied.

13. The method of claim 12 wherein the post of the earring is installed in the opening of the patch prior to adhering the patch to the earlobe.

14. The method of claim 12 wherein the post of the earring is installed first in the passage and is positioned and temporarily held by the person in the upper portion of the passage, and thereafter the patch is adhered to the earlobe to support and maintain the earring in the upper portion.

15. The method of claim 12 including forming the patch to have an outer dimension of between about 3/16 inch diameter and 3/8 inch diameter.

16. The method of claim 12 including forming the opening in the patch prior to adhering the patch to the earlobe by extending the post through the patch material so that the opening is about the same diameter as that of the post.

17. The method of claim 12 including positioning the patch on the earlobe to overlie and bridge the lower damaged portion of the earlobe.

18. The method of claim 12 including providing an additional such patch, and adhering the patches to the opposite front and back surfaces of the earlobe such that each is confined only to the surface of the earlobe to which it is applied and with the post of the earring projecting through the support opening in each patch.

19. A method of reinforcing a passage extending between opposite front and back sides of a wearer's pierced earlobe to provide support to an earring having a post adapted for extension through the passage of the earlobe, said method comprising the steps of:

providing a patch of reinforcement material having opposite sides and an adhesive applied to at least one of the sides and being of such size that it may be affixed releasably to one surface of the earlobe of the wearer in position over the passage and confined only to the surface of the earlobe to which it is applied;

prior to adhering the patch to the earlobe, extending the post of the earring through the passage of the earlobe; and after the post has been installed within the passage, adhering the patch to one surface of the earlobe in position over the passage and with the post of the earring projecting through an aligned opening in the patch to support and maintain the earring in position within the passage and with the patch being confined only to the surface of the earlobe to which it is applied.

20. A method of reinforcing a passage extending between a front and back surfaces of a wearer's pierced earlobe to provide support to an earring having a post adapted for insertion through the passage of the earlobe, said method comprising the steps of:

providing two disconnected patches of reinforcement material each having opposite sides and each having an adhesive applied to at least one of its sides and each being of such size that it may be adhered to the front or back surface of the earlobe of the wearer in position over the passage and confined only to the respective surface of the earlobe to which it is applied;

extending the post of the earring through the passage of the earlobe; and adhering the patches to the front and back surfaces of the earlobe in position over the passage of the earlobe with the post of the earring projecting through the openings of the patches and with each patch being confined only to the respective surface of the earlobe to which it is applied.

21. A method of reinforcing a passage extending between opposed front and back surfaces of a wearer's earlobe to provide support to an earring having a post adapted for extension through the passage, said method comprising the steps of:

providing a patch of reinforcement material having opposite sides and an adhesive applied to each of the sides and the patch being of such size that the patch may be affixed releasably to the earlobe of the wearer in position over the passage with the patch being confined only to the surface of the earlobe to which it is applied;

extending the post of the earring through the passage of the earlobe; and adhering one surface of the patch to one surface of the earlobe in position over the passage with the patch being confined only to the surface of the earlobe to which it is applied and adhering the other surface of the patch to a portion of the earring facing said other surface and with the post projecting through a support opening in the patch aligned with the passage and the post.

22. A method of reconstructing a person's torn earring support passage to enable the person to support an earring in an original upper portion of the passage corresponding to the original location of the passage before being torn above a lower damaged portion of the passage, said method comprising the steps of:

providing a patch of reinforcement material having opposite sides and an adhesive applied to at least one of the sides;

extending a post of the earring into the passage and bodily positioning and holding the post within the upper original portion of the passage; and thereafter adhering the patch to the person's skin to extend across and bridge the lower damaged portion of the passage thereby supporting and maintaining the post of the earring within the upper portion of the passage and preventing the post from dropping into the lower damaged portion of the passage.

* * * * *